United States Patent [19]

Brumfield

[11] 4,436,264

[45] Mar. 13, 1984

[54] FLYING DEVICE

[76] Inventor: Elmer B. Brumfield, 1136 W. Long, Stephenville, Tex. 76401

[21] Appl. No.: 406,491

[22] Filed: Aug. 9, 1982

[51] Int. Cl.[3] ..... B64C 31/06

[52] U.S. Cl. ..... 244/153 R; D12/325; D21/85; 46/74 D; 46/76 R; 244/34 A

[58] Field of Search ..... 244/153 R, 154, 23 C, 244/12.2, 3 HA, 45 R; D12/325; D21/85, 86, 89; 46/74 R, 74 D, 76 R, 77, 81; 273/424, 425

[56] References Cited

U.S. PATENT DOCUMENTS

| | | | |
|---|---|---|---|
| D. 166,440 | 4/1952 | Benson | D21/86 |
| D. 171,327 | 1/1954 | Gould | D21/86 |
| D. 212,017 | 8/1968 | Kennedy | D21/86 |
| 2,726,829 | 12/1955 | Hillis | 244/12.2 |
| 2,843,339 | 7/1958 | Streib | 244/12.2 |
| 3,086,738 | 4/1963 | Lubash | 244/153 A |
| 3,100,895 | 8/1963 | Resnick | 244/153 A |
| 3,128,974 | 4/1964 | Teague, Jr. | 244/153 R |
| 3,185,480 | 5/1965 | Weyman et al. | 273/365 |
| 3,330,512 | 7/1967 | Null | 244/153 R |
| 3,383,073 | 5/1968 | Clover | 244/23 C |
| 3,547,384 | 12/1970 | Clark | 244/154 |
| 3,715,833 | 2/1973 | Nickerson et al. | 46/74 D |
| 3,918,663 | 11/1975 | Cornelison | 244/153 |
| 4,307,856 | 12/1981 | Walker | 244/34 A |
| 4,354,647 | 10/1982 | Carpenter | 244/153 R |

*Primary Examiner*—Galen L. Barefoot

*Attorney, Agent, or Firm*—Munson H. Lane, Jr.

[57] ABSTRACT

A kite or flying device comprising a substantially ring-shaped body member formed of foam plastic, the normally upper surface of said body member being flat, the normally lower surface of said body member being part of the surface of a sphere, the ring-shaped body member being bounded by a radially outer circumference and by a radially inner circumference, diametrically opposite portions of said outer circumference respectively defining the leading edge and the trailing edge of the kite body, an open area bounded by and lying radially inwardly of said radially inner circumference, a bar-like member carried by the kite body and lying on a diameter of said kite body, said diameter extending from the leading edge to the trailing edge, the bar-like member being in bridging relation to the open area, the bar-like member being provided with apertures permitting attachment of a kite string or towline to the bar-like member, and rudders carried by the kite body contiguous the trailing edge of the kite body.

9 Claims, 3 Drawing Figures

FLYING DEVICE

BACKGRDUND OF THE INVENTION

1. Field of the Invention

This invention relates to a flying device such as a kite or the like, and more particularly to a kite of substantially ring shape made of a light weight material, such as foam plastic, and adapted to be tethered by a tow-line controlled by the person flying the kite.

2. Discussion of the Prior Art

It is broadly known in the prior art to construct kites or analogous flying devices of round or annular shape, as exemplified by the following U.S. patents:

U.S. Pat. No. 3,086,738—issued to John J. Lubash on Apr. 23, 1963;

U.S. Pat. No. 3,100,895—issued to Arthur Resnick on Aug. 13, 1963;

U.S. Pat. No. 3,185,480—issued to Robert D. Weyman et al. on May 25, 1965:

U.S. Pat. No. 3,330,512—issued to James R. Null on July 11, 1967;

U.S. Pat. No. 3,547,384—issued to Louis J. Clark on Dec. 15, 1970;

U.S. Pat. No. 3,918,663—issued to Floyd S. Cornelison, Jr. on Nov. 11, 1975;

Design U.S. Pat. No. 212,017—issued to Donald J. Kennedy on Aug. 20, 1968.

STATEMENT OF THE INVENTION

It is an object of the present invention to provide a ring-type kite which is uncomplicated in its construction and inexpensive to manufacture, and which can therefore be sold at a relatively low price.

It is a further object of the invention to provide a kite which can be formed of a light weight material such as foam plastic (polystyrene) which can be molded in molds of simple design.

It is still a further object of the invention to provide a kite formed of light weight material which is an improvement over the prior art and which is aerodynamically correct.

It is still a further object of the invention to provide a kite which is so constructed and which has aerodynamic characteristics such that the kite does not require a bridle to maintain its correct position in the wind, and merely has a tow line connected to a single point on the kite to provide an automatic inclination of the kite at the optimum angle for efficient flying of the kite.

It is a further object of the invention to provide a ring type kite which is so constructed as to provide a large dimension with a relatively small amount of material.

BRIEF SUMMARY OF THE INVENTION

In achievement of these objectives, there is provided in accordance with an embodiment of the invention a flying device or kite substantially in the shape of a ring which is formed, preferably by molding, of a light weight material such as foam plastic (polystyrene). The ring-shaped kite body has an area bounded at its radially outer and radially inner peripheries, respectively, by outer and inner concentric circles, with the space lying radially inwardly of the inner circle being open except for two diametrically opposite projections forming part of the kite body and which extend radially inwardly of the inner circle. A bar member of light weight material extends along a diameter of the kite body across the open space bounded by the inner circle, with the opposite ends of the bar member being anchored in the two oppositely-disposed radially inwardly extending projections, preferably during the molding process. The bar member is provided with one or more holes or apertures, one of which is selectively used for attaching the string or tow line of the kite. The upper surface of the kite body is flat, while the lower or deflecting surface of the kite body is part of the surface of a sphere, such as a sphere of three (3) feet radius. Two rudders or vanes are secured to the under surface of the kite body at the trailing edge of the kite body, the two rudders being spaced apart from each other circumferentially of the kite body, and being positioned symmetrically on opposite sides of the longitudinal axis on which the string attachment bar lies.

Further objects and advantages of the invention will become apparent from the following description taken in conjunction with the accompanying drawing in which:

DESCRIPTION OF THE PREFERRED EMBODIMENT

Figure 1:
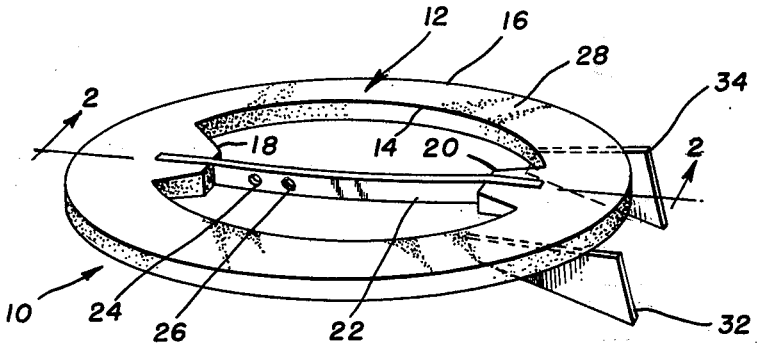
FIG. 1 is perspective view of the ring kite in accordance with the invention.
Figure 2:
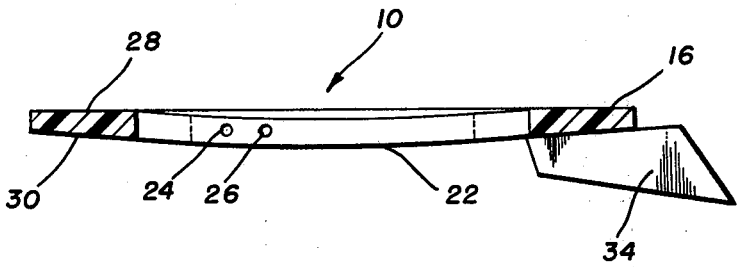
FIG. 2 is a view taken along line 2—2 of FIG. 1.
Figure 3:
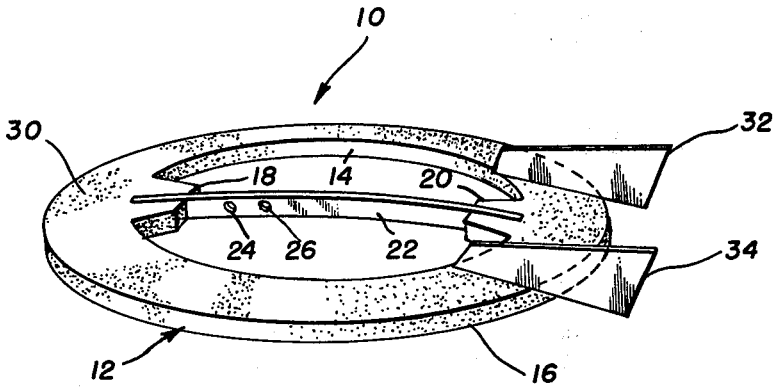
FIG. 3 is a perspective view of the kite of FIGS. 1 and 2 as viewed from the bottom of the kite.

Referring now to the drawing, there is shown a ring type kite generally indicated at 10 which is formed of a suitable light weight material such as plastic foam (polystyrene), for example. Kite 10 is preferably formed by a molding process.

Kite 10 includes a body member generally indicated at 12 of generally ring shape, including an outer circle or circumference 16, and an inner circle or circumference 14 which is concentric with outer circle 16 but which is interrupted at diametrically opposite regions thereof by radially inwardly extending integral projections of truncated triangular shape, respectively indicated at 18 and 20. A bar 22 extends along the longitudinal axis of the kite between the two diametrically oppositely-disposed projections 18 and 20, preferably during the molding process. Bar 22 may be made of any suitable light weight material, such as wood, or a light weight metal. Bar 22 serves as a means for securing a string or tow line to the kite. Bar 22 is provided with two holes or apertures therein respectively indicated at 24 and 26. Hole 26 is located at point which is three-fourth's ($\frac{3}{4}$) of the radial distance from the leading edge of the kite body to the center of the outer circle 16, while hole 24 is a short distance, such as one inch, closer than hole 26 to the leading edge of the kite body. As indicated by the legends in FIG. 1, the leading edge of the kite is at the left with respect to the view shown in FIG. 1, while the trailing edge of the kite is at the right with respect to the view shown in FIG. 1.

The upper surface 28 of kite body 12 is planar or flat, while the lower or deflecting under surface 30 of kite body 12 is spherical, being part of the surface of a sphere which may be of three (3) feet radius, for example. The upward curving of the side of the kite body, as defined by the spherical under surface 30, gives the kite lateral stability.

A pair of twin rudders or vanes respectively indicated at 32 and 34 are suitable secured to the under surface 30 of the kite in spaced relation to each other circumferentially of the kite body at the trailing edge of the kite, the two vanes being symmetrically positioned on opposite sides of the longitudinal axis of the kite at the trailing edge of the kite.

The kite is open in the region bounded by the inner circumference 14 and by the radially inner periphery of the truncated projections 18 and 20. This open construction permits two kites to fly in tandem (one above the other) with the tow line or string for each of the kites being attached at the same corresponding hole such as 26 on the corresponding bar 22 of the corresponding tandem kite.

The kite construction hereinbefore described is aerodynamically correct as proved by the fact that the kite when flown remains suspended in space on the end of a string attached to either hole 26 on bar 22, the preferred location for connection of the string or tow line, or, alternatively, if the string may be attached to hole 24 on bar 22. If the string is attached to hole 26 which, as previously mentioned, is located at a point ¾ of the radial distance from the outer circle (leading edge) to the center of circle 16, the kite will automatically incline at an angle of 45 degrees, which is the best angle for efficient flying. If the string is attached to the hole 24 which is about one inch closer to the leading edge than hole 26, the kite will incline at an angle less than 45 degrees, and the kite will fly more directly overhead.

While there has been shown and described a particular embodiment of the invention, it will be obvious to those skilled in the art that various changes and modifications may be made therein and, therefore, it is aimed in the appended claims to cover all such changes and modifications as fall within the true spirit and scope of the invention.

The embodiments of the invention in which an exclusive property or privilege is claimed are defined as follows:

1. A kite fabricated of a lightweight material and comprising:

an annular body having a circular outer periphery, at least a generally circular inner periphery, and a relatively thin height with respect to its radial extent;

the annular body having a flat unobstructed top surface and a bottom surface which is part of the surface of a sphere;

a bar element lying on a diameter of the annular body and secured at its ends to the annular body at said inner periphery;

the bar element limited in height to confinement between the plane of said top surface and the surface of the sphere;

the bar element being structured so as to directly accommodate the kit tow line at a forward location; and rudder means disposed at the trailing location of the annular body and in symmetry with said diameter.

2. A kite as in claim 1 wherein said securing of the bar ends is effected by anchoring the bar ends in projections of the annular body's inner periphery.

3. A kite as in claim 1 wherein said rudder means comprise a pair of vane-like elements.

4. A kite as in claim 2 wherein said rudder means comprise a pair of vane-like elements.

5. A kite as in claim 1 wherein the means by which the bar element is structured at said forward location so as to directly accommodate the kite tow line comprises defined apertures which are selective in use.

6. A kite as in claim 2 wherein the means by which the bar element is structured at said forward location so as to directly accommodate the kite tow line comprises defined apertures which are selective in use.

7. A kite as in claim 3 wherein the means by which the bar element is structured at said forward location so as to directly accommodate the kite tow line comprises defined apertures which are selective in use.

8. A kite as in claim 4 wherein the means by which the bar element is structured at said forward location so as to directly accommodate the kit tow line comprises defined apertures which are selective in use.

9. A kite as in claim 1 wherein the lightweight material is a plastic foam.

* * * * *